US006113360A

United States Patent [19]

Yu et al.

[11] Patent Number: 6,113,360

[45] Date of Patent: Sep. 5, 2000

[54] GEROTOR PUMP

[75] Inventors: Dequan Yu, Ann Arbor, Mich.; Gerard Cronin, Bishops Stortford, United Kingdom; Ronald Engel, Frechen, Germany

[73] Assignee: Ford Motor Company, Dearborn, Mich.

[21] Appl. No.: 09/122,362

[22] Filed: Jul. 27, 1998

[51] Int. Cl.[7] ..... F04B 49/00

[52] U.S. Cl. ..... 417/310; 417/440; 418/171

[58] Field of Search ..... 417/310, 440; 418/171

[56] References Cited

U.S. PATENT DOCUMENTS 2,724,335 11/1955 Eames ..... 417/310

2,813,488 11/1957 Deska ..... 417/310

5,372,484 12/1994 Briggs et al. ..... 417/310

5,733,111 3/1998 Yu et al. .

5,759,013 6/1998 Miyazaki et al. ..... 417/310

*Primary Examiner*—Thomas Denion

*Assistant Examiner*—Thai-Bu Trieu

*Attorney, Agent, or Firm*—Mark L. Mollon

[57] ABSTRACT

A gerotor pump includes a pressure relief return flow guide system, composed of two distinct structures, a pressure relief port, and a flow guide. The pressure relief port separates the pressure relief flow and inlet flow, preventing them from mixing and causing turbulence in the inlet cavities. The flow guide is located at the end of the pressure relief port and the inlet to make the two flows smoothly merge in the inlet cavities.

7 Claims, 3 Drawing Sheets

GEROTOR PUMP

FIELD OF THE INVENTION

This invention relates to gerotor pumps, and more particularly, to pressure relief return flow management systems in gerotor pumps.

BACKGROUND OF THE INVENTION

Gerotor type hydraulic pumps typically include internally toothed and externally toothed gear members rotatably disposed within a pump housing. The gear members are coupled to the engine in such a way as to rotate in proportion to engine speed. The teeth on the respective gears cooperate to define a plurality of variable volume pumping chambers whereupon during rotation of the gear members, a pumping chamber increases in volume to a maximum volume, then decreases in volume. Fluid from the pump's low pressure inlet port is drawn into pumping chambers that are increasing in volume. Upon further rotation of the gerotor when the pumping chambers are decreasing in volume, the fluid is pushed out through the pump's outlet port at a higher pressure. As the engine rotates at a higher speed, oil pressure may increase to undesirable levels. To overcome this situation, a pressure relief valve is provided in the pump to direct the excess oil back to the pump inlet cavities. The flow of the fluid which is emitted from the relief port to the low pressure side of the pump, however, is not guided in any way once it passes through the relief valve outlet. When this return flow is relieved from the high-pressure side of the pump, it must merge with the inlet flow from the pump, which supplies fluid to the low-pressure side of the pump. Because the return flow and inlet flow are traveling in opposite directions, the pressure and flow rate become unstable, causing "flow dip", a decrease in net inlet flow, and "pressure dip", a drop in pressure that results from turbulence. In particular to an engine oil pump, the traditional method for avoiding this pressure and flow rate instability which effects the pump's capability to adequately lubricate the engine, has been to operate the pump with a pressure relief setting 20% greater than the engine requirement. This practice results in not only the necessity for an oversized pump which hinders fuel economy, but also creates a potential noise concern, as the pressure pulsation causes a vibration.

SUMMARY OF THE INVENTION

An object of the present invention is to provide a gerotor pump which effectively manages excess flow from the pressure relief valve and overcomes the disadvantages of prior pumps. This object is achieved and disadvantages of prior art approaches are overcome by providing a novel gerotor pump. In one particular aspect of the invention, the gerotor pump includes a pump housing, an internally toothed gear member rotatably disposed within the pump housing, and an externally tooth gear member rotatably disposed within the pump housing. The externally toothed gear cooperates with the internally toothed gear member to define a plurality of variable volume pumping chambers whereupon during rotation of the gear members, a pumping chamber increases in volume to a maximum volume, then decreases in volume. A generally arcuate inlet channel is formed in the pump housing and communicates exclusively with pumping chambers that are increasing in volume. A generally arcuate outlet channel is formed in the pump housing and communicates exclusively with pumping chambers that are decreasing in volume. A pressure relief return flow guiding system, comprising a pressure relief port, communicating with the outlet channel and the inlet channel for directing excess fluid from the outlet channel to the inlet channel, and a flow guide, disposed at one end of the relief port adjacent to the inlet channel, with the flow guide directing fluid flow from the relief port to the inlet channel such that the fluid flows in a same direction as fluid flow in the inlet channel. The pump housing may comprise a pump body and a pump cover. The guide form may be formed in either the pump body or pump cover or both.

An advantage of the present invention is that turbulence within the pump is avoided, thus avoiding pressure dip.

Another advantage of the present invention is that the relief return flow does not counteract with the inlet flow, thus avoiding flow dip.

Still another advantage of the present invention is that a gerotor pump having a relatively high pumping efficiency is provided.

Yet another advantage of the present invention is that it provides steady flow at various speeds.

Even another advantage of the present invention is that it eliminates the need for any external line, and associated external couplings, thus conforming to strict spatial considerations.

Other objects, features and advantages of the present invention will be readily appreciated by the reader of this specification.

BRIEF DESCRIPTION OF THE DRAWINGS

The invention will now be described, by way of example, with reference to the accompanying drawings, in which.

DETAILED DESCRIPTION OF THE PREFERRED EMBODIMENT

Figure 1:
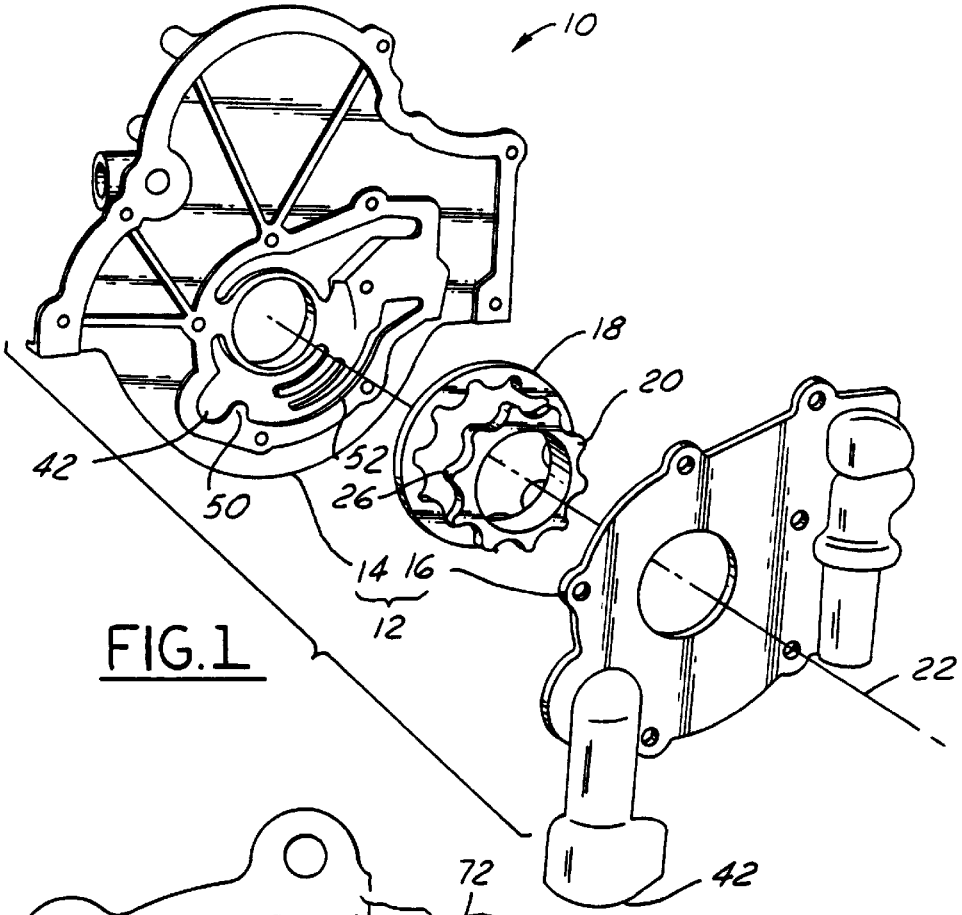
FIG. 1 is a perspective view of a gerotor pump according to one aspect of the present invention.
Figure 3:
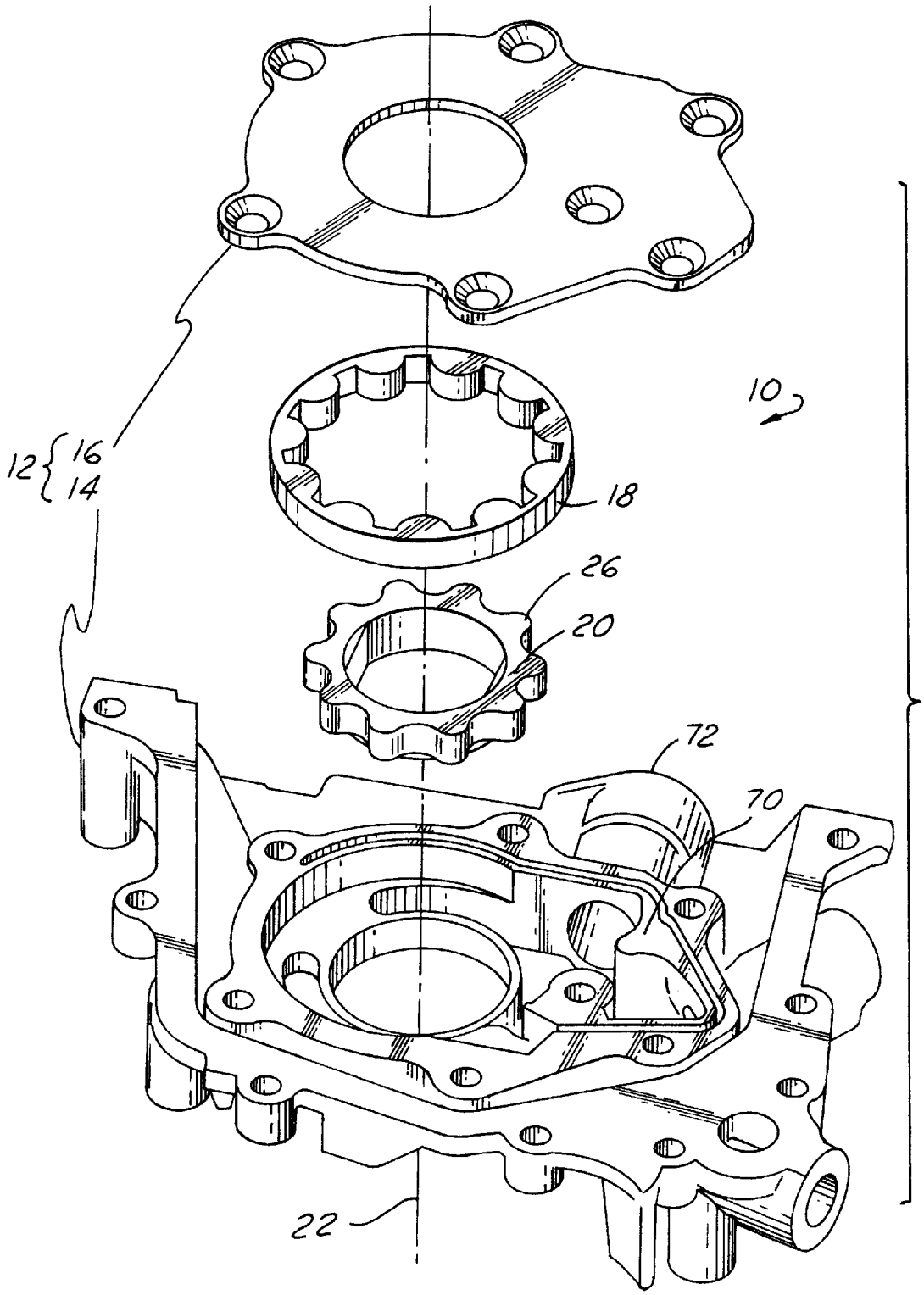
FIG. 3 is a perspective view of a gerotor pump according to another aspect of the present invention.

Referring to the Figures, and in particular to FIGS. 1 and 3, gerotor pump 10 includes pump housing 12, having pump body 14 and pump cover 16, and internally and externally toothed gear members 18, 20, each having a plurality of teeth 26, disposed within housing 12. Externally toothed gear member 20 is supported for rotation about axis 22. Internally toothed gear member 18 is supported for rotation about an axis which is spaced from axis 22 so as to provide the necessary gear eccentricity for proper operation of gerotor pump 10, as is well known to those skilled in the art. In addition, externally toothed gear member 20 has one less tooth 26 than that of internally tooth gear member 18, so as to reduce excessive wear on any one portion of the gears. Teeth 26 on the respective gears cooperate to define a plurality of variable volume pumping chambers whereupon during rotation of gear members 18, 20, a pumping chamber increases in volume to a maximum volume, then decreases in volume to pump fluid therethrough.

Figure 4:
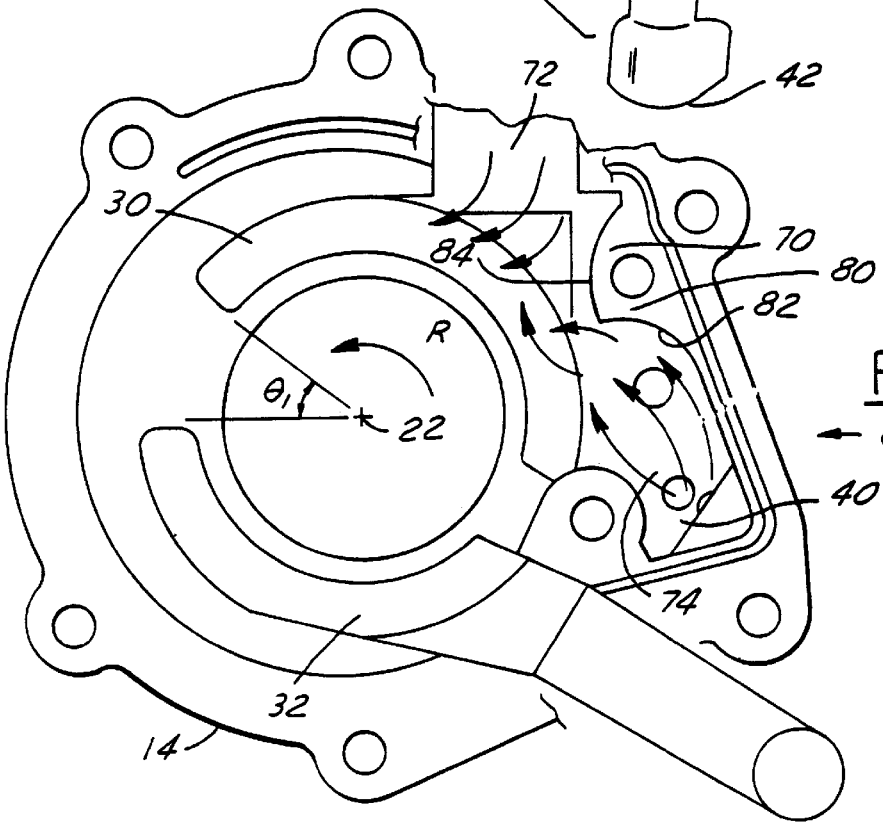
FIG. 4 is a schematic plan view of a portion of the pump shown in FIG. 3.
Figure 2:
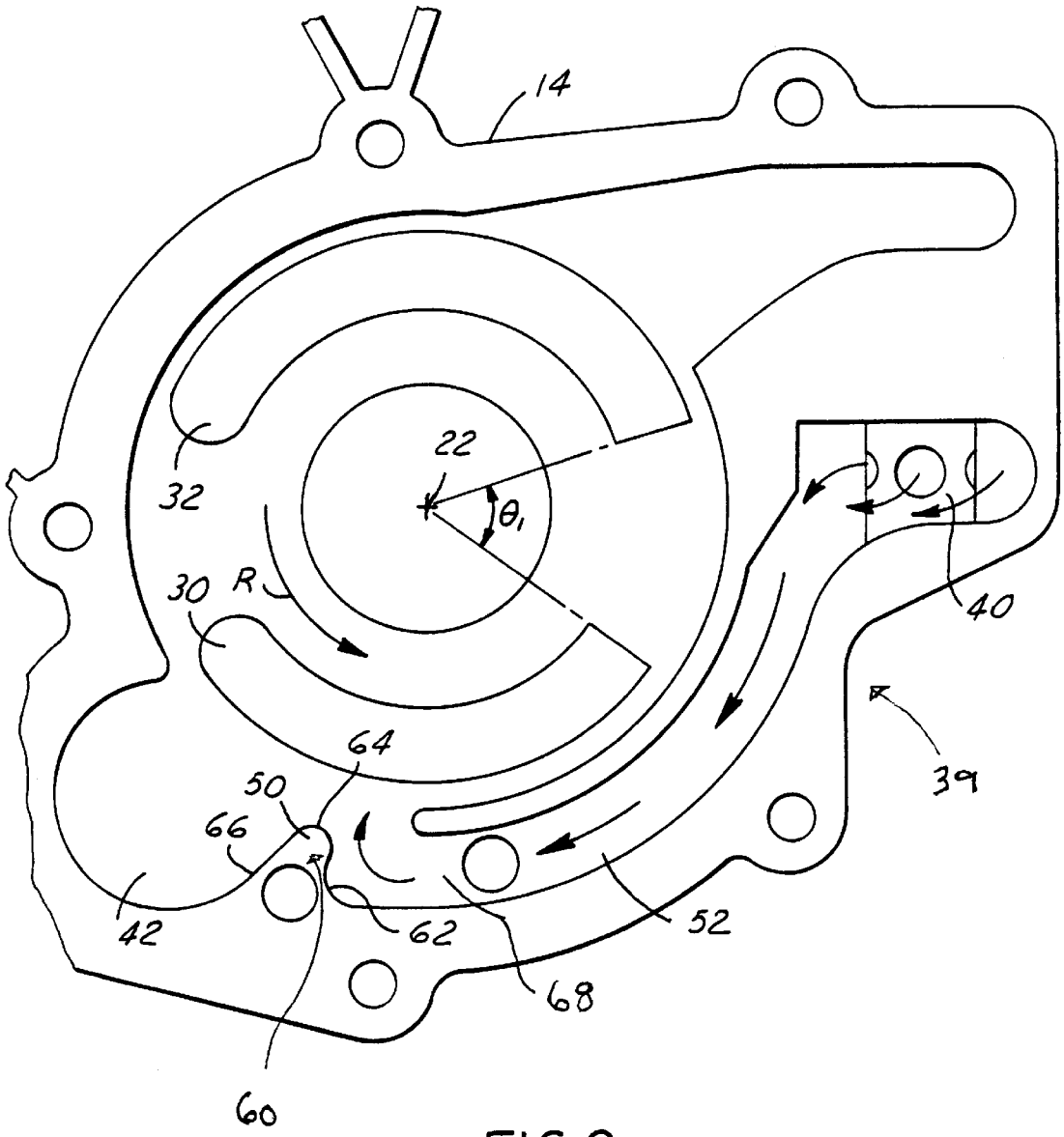
FIG. 2 is a schematic plan view of a portion of the pump shown in FIG. 1.

Turning now to FIGS. 2 and 4, pump body 14 also includes arcuately shaped inlet and outlet channels 30, 32 formed in pump body 14. Inlet channel 30 communicates exclusively with pumping chambers that are increasing in volume and outlet channel 32 communicates exclusively with pumping chambers that are decreasing in volume. Accordingly, as gear members 18, 20 rotate in the direction shown as "R", fluid is drawn in through inlet channel 30 by the action of the increasing volume pumping chambers and is pumped out through outlet channel 32 at a higher pressure by the action of the decreasing pumping chambers. Inlet and outlet channels 30, 32 are prevented from simultaneously communicating with an open mesh pumping chamber, which is near a maximum volume. That is, as the fluid transitions from the low pressure inlet channel 30 to the high pressure outlet channel 32, the fluid in the open mesh pumping chamber is prevented from directly communicating with either the inlet or outlet channels 30, 32. Inlet and outlet channels 30, 32 are thus separated by an angle, shown as $\theta_1$, which is between about 100% and about 120% of a nominal separation angle $\theta$. This nominal separation angle $\theta$ is defined by 360° divided by the number of teeth 26 on externally toothed gear member 20 and represents the angle when the open mesh pumping chamber is at maximum volume. For example, suppose externally toothed gear member 20 has ten teeth. The nominal separation angle $\theta$ would be 36°. Thus, the separation angle $\theta_1$ separating inlet and outlet channels 30, 32 would be between about 36° and about 43.2°, which represents between about 100% and about 120% of the nominal separation angle $\theta$.

Pump body 14 further includes return flow guide system 39 having relief valve 40 and relief port 52, by which return flow from the pumping chambers decreasing in volume is allowed to flow into inlet port 42. The relief return flow and the inlet flow undoubtedly interact with one another as they enter the pumping chambers. With the prior art, the relief return flow and inlet flow travel in different directions before entering the pumping chambers. Regardless of which direction the relief return flow is traveling relative to the gear rotation, the merging of these two flows causes turbulence, as they are flowing in different directions, which results in pressure dip. The relief return flow may also interfere with the inlet flow, causing flow dip. In fact, if the relief flow exceeds the inlet flow, the gerotor could experience a net flow out of inlet 42.

Turning now to FIGS. 1 and 2, which are graphical representations of one embodiment of the present invention, a gerotor pump 10 in which the relief return flows in the direction opposite the gear rotation is shown. FIG. 1 depicts a return flow guide system 39 also having flow guide 50 formed adjacent inlet port 42 in body 14, in order to prevent the flow from pressure relief port 52 and the inlet flow from interacting with one another while traveling in opposite directions. Adjacent to flow guide 50, depicted in FIG. 1, is relief port 52 which isolates the return flow from the fluid occupying inlet cavities 30. Relief port 52, which extends from relief valve 40 to inlet 42, guides the return flow toward flow guide 50, where the direction of its flow can be altered to match that of the fluid within inlet cavities 30 (see FIG. 2). The arrows in FIG. 2 are meant to represent the direction of flow in a specific area of gerotor pump 10. The gear represented in FIG. 2 is rotating in the counterclockwise direction, as indicated by the arrow labeled "R". Flow guide 50, as illustrated in FIG. 2, also directs fluid from inlet 42 to flow in a similar direction to that of the fluid present in inlet cavities 30. In the example shown in FIGS. 1 and 2, flow guide 50 includes inwardly extending tab 60 having a concave face 62, convex face 64 conjoined with face 62, and inlet face 68 conjoined with face 64 and inlet port 42. Concave face 62 is formed adjacent end 66 of port 52.

Referring now to FIGS. 3 and 4, which are graphical representations of another embodiment of the present invention, a gerotor pump 10 in which the relief return flows in the direction of the gear rotation is shown. FIG. 3 depicts return flow guide system 69 having a flow guide 70 formed adjacent inlet port 72. The arrows in FIG. 4 are meant to represent the direction of flow in a specific area of gerotor pump 10. The gear represented in FIG. 4 is rotating in the counterclockwise direction, as indicated by the arrow labeled "R". Flow guide 70, as illustrated by FIG. 4, alters the flow from relief valve 40 so as to avoid turbulence and negative flow in the inlet, as discussed above. Adjacent to flow guide 70, is relief port 74. Though relief port 74 in this embodiment serves a similar purpose to that in the embodiment depicted in FIGS. 1 and 2, to direct fluid from relief valve 40 in an appropriate manner, the relief port 74 for this embodiment is generally shorter and not have the separating wall which distinguishes it from pump inlet cavity 30, as the directions of flow in this embodiment do not necessitate such separation or length. In the example shown in FIGS. 3 and 4, flow guide 70 includes inwardly extending tab 80 having concave face 82 and convex face 84 conjoined with face 82.

While the best mode for carrying out the invention has been described in detail, those skilled in the art in which this invention relates will recognized various alternatives and embodiments, including those mentioned above, in practicing the invention that has been defined by the following claims.

What is claimed is:

1. A gerotor pump for pumping fluids comprising:

a pump housing;

an internally toothed gear member rotatably disposed within said pump housing;

an externally toothed gear member rotatably disposed within said pump housing, with said externally toothed gear member cooperating with said internally toothed gear member to define a plurality of variable volume pumping chambers whereupon during rotation of said gear members, a pumping chamber increases in volume to a maximum volume then decreases in volume;

a generally arcuate inlet port formed in said pump body, with said inlet port communicating exclusively with pumping chambers that are increasing in volume;

a generally arcuate outlet port formed in said pump body, with said outlet port communicating exclusively with pumping chambers that are decreasing in volume; and, a pressure relief return flow guiding system, comprising a pressure relief port, communicating with said outlet port and said inlet port for directing excess fluid from said outlet port to said inlet channel, with fluid flowing in said port in a direction opposite to fluid flowing in said inlet and outlet channels, and a flow guide, disposed at one end of said relief port adjacent to said inlet channel, with said flow guide directing fluid flow from said relief port to said inlet port such that said fluid flows in a same direction as fluid flow in said inlet channel.

2. A gerotor pump according to claim 1 wherein said pressure relief port prevents return flow from directly flowing into said inlet when the return flow direction is opposite the gear rotation direction.

3. A gerotor pump according to claim 1 wherein said flow guide has two faces, one face being concave and cooperating with said relief port to redirect the return flow into the inlet flow.

4. A gerotor pump according to claim 1 wherein said housing comprises a pump body and a pump cover, with said flow guide being formed in said pump body and with said relief port being formed in said pump cover.

5. A gerotor pump according to claim 1 wherein said housing comprises a pump body and a pump cover, with said relief port and said flow guide being formed in said pump body.

6. A gerotor pump according to claim 1 wherein said housing comprises a pump body and a pump cover, with said flow guide being formed in said pump body and with said relief port being formed in both said pump body and said pump cover.

7. A gerotor pump according to claim 1 wherein said housing comprises a pump body and a pump cover, with said relief flow port and said flow guiding form being formed in said pump cover.

* * * * *